US006062983A

United States Patent [19]

Butsook

[11] Patent Number: 6,062,983

[45] Date of Patent: May 16, 2000

[54] COMBINATION WATER SLIDE AND POOL

[76] Inventor: Peter Butsook, 8548 Adoree St., Downey, Calif. 90242

[21] Appl. No.: 09/345,869

[22] Filed: Jul. 1, 1999

[51] Int. Cl.[7] ..... A63G 21/18

[52] U.S. Cl. ..... 472/117; 472/128; 4/488

[58] Field of Search ..... 472/116, 117, 472/128, 134; 104/69; 4/494, 586, 488, 499; 182/48

[56] References Cited

U.S. PATENT DOCUMENTS

| | | | |
|---|---|---|---|
| 2,982,547 | 5/1961 | Carrier | 472/117 |
| 3,363,268 | 1/1968 | Friedlander | 472/128 |
| 4,434,870 | 3/1984 | Fisher | 182/48 |
| 4,723,628 | 2/1988 | Fisher | 182/48 |
| 4,762,316 | 8/1988 | Merino | 472/117 |
| 5,154,671 | 10/1992 | Smollar et al. | 472/117 |

*Primary Examiner*—Kien T. Nguyen
*Attorney, Agent, or Firm*—Goldstein & Canino

[57] ABSTRACT

A combination water slide and pool including an inflatable elongated sliding sheet. An elevation ramp is secured to a lower surface of the sliding sheet inwardly of a short inner edge thereof. The elevation ramp has its apex at the short inner edge of the sliding sheet. A pool portion is secured to the short inner edge of the sliding sheet. The pool portion is comprised of a peripheral side wall.

2 Claims, 2 Drawing Sheets

FIG 2
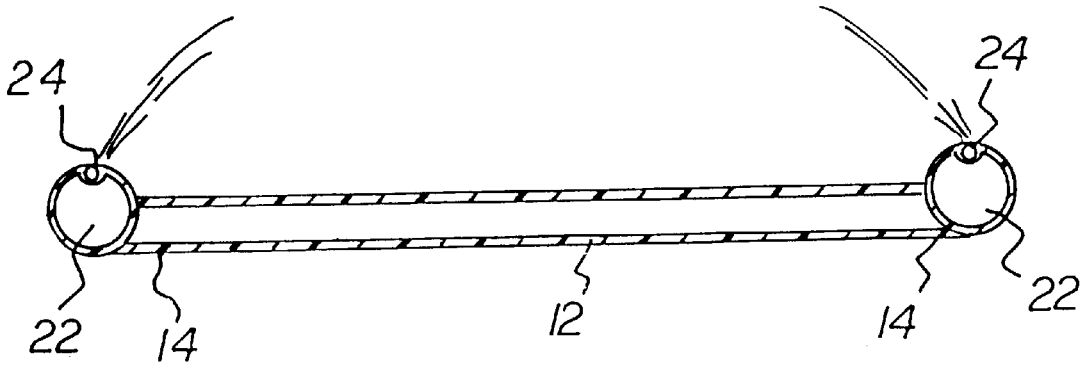
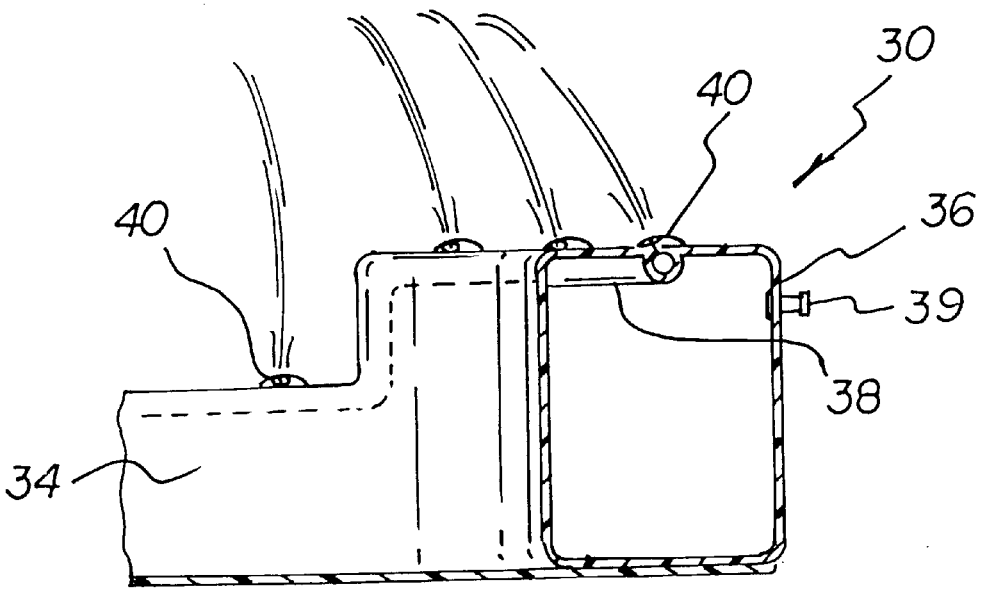
FIG 3

COMBINATION WATER SLIDE AND POOL

BACKGROUND OF THE INVENTION

The present invention relates to a combination water slide and pool and more particularly pertains to providing recreation and amusement for children.

The toy water slide is generally comprised of an elongated strip of plastic material that is secured to a ground area with a water sprinkler or hose placed in proximity to the water slide to create a wet and slippery surface of the strip of plastic material. A child can then run towards the strip and either slide or flop towards the strip with the inertia created by the run causing the child to slide over the elongated strip, usually terminating on the exposed ground area at the end of the strip. What is needed is a place that the child can end their slide in that is not an exposed area of ground where the risk of injury is greater.

The present invention seeks to solve the above mentioned problem by providing a device that includes an elongated sliding surface that terminates in a small wading pool which will receive a sliding child at the end of their slide.

The use of toy water slides is known in the prior art. More specifically, toy water slides here to fore devised and utilized for the purpose of entertaining children are known to consist basically of familiar, expected and obvious structural configurations, notwithstanding the myriad of designs encompassed by the crowded prior art which have been developed for the fulfillment of countless objectives and requirements.

By way of example, U.S. Pat. Nos. 5,669,822 and 5,507,696 both to Smollar disclose water slides with interconnecting tubes, which may be filled with water. Some of the tubes form the sidewalls of the pool, while the other tubes form bumps of graduated height to provide a ramp at the end of the slide. U.S. Pat. No. 5,551,922 to Katz discloses an elongated slide sheet terminating into a pool. The inflatable sidewalls have heat welded seams which create a depressed serpentine path between them. U.S. Pat. No. 5,401,214 to Smollar discloses a water slide with an inflatable set of tubes to form a ramp in the center, wherein a spray of water is delivered from each side.

While these devices fulfill their respective, particular objective and requirements, the aforementioned patents do not describe a combination water slide and pool for providing recreation and amusement for children.

In this respect, the combination water slide and pool according to the present invention substantially departs from the conventional concepts and designs of the prior art, and in doing so provides an apparatus primarily developed for the purpose of providing recreation and amusement for children.

Therefore, it can be appreciated that there exists a continuing need for a new and improved combination water slide and pool which can be used for providing recreation and amusement for children. In this regard, the present invention substantially fulfills this need.

SUMMARY OF THE INVENTION

In the view of the foregoing disadvantages inherent in the known types of toy water slides now present in the prior art, the present invention provides an improved combination water slide and pool. As such, the general purpose of the present invention, which will be described subsequently in greater detail, is to provide a new and improved combination water slide and pool and method which has all the advantages of the prior art and none of the disadvantages.

To attain this, the present invention essentially comprises an inflatable elongated sliding sheet having a generally rectangular configuration. The sliding sheet has a periphery defined by a long opposed side edges, a short outer edge, and a short inner edge. An elevation ramp is secured to a lower surface of the sliding sheet inwardly on the short inner edge thereof. The elevation ramp has its apex at the short inner edge of the sliding sheet. A peripheral conduit extends around the long opposed side edges and the short outer edge of the sliding sheet and terminates in open ends at opposing inner ends of the long opposed side edges. The peripheral conduit has a plurality of pin holes through an upper surface thereof in a spaced relationship. The peripheral conduit has a water intake line in communication therewith. The peripheral conduit has an air intake which is designed to inflate the slide so as to provide a cushion for the users. A pool portion is secured to the short inner edge of the sliding sheet. The pool portion is comprised of a peripheral side wall. The peripheral side wall has a pair of end sections at a height equal to the apex of the ramp and an intermediate section at an elevated height. The peripheral side wall has a conduit extending therein. The conduit is in communication with the open ends of the peripheral conduit. The conduit of the pool portion has a plurality of spray nozzles in communication therewith and disposed within an upper surface of the peripheral side wall in a spaced relationship.

There has thus been outlined, rather broadly, the more important features of the invention in order that the detailed description thereof that follows may be better understood, and in order that the present contribution to the art may be better appreciated. There are, of course, additional features of the invention that will be described here in after and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

It is therefore an object of the present invention to provide a new and improved combination water slide and pool which has all the advantages of the prior art toy water slides and none of the disadvantages.

It is another object of the present invention to provide a new and improved combination water slide and pool which may be easily and efficiently manufactured and marketed.

It is a further object of the present invention to provide a new and improved combination water slide and pool which is of durable and reliable construction.

An even further object of the present invention is to provide a new and improved combination water slide and pool which is susceptible of a low cost of manufacture with regard to both materials and labor, and which accordingly is then susceptible of low prices of sale to the consuming public, thereby making such a combination water slide and pool economically available to the buying public.

Even still another object of the present invention is to provide a new and improved combination water slide and pool for providing recreation and amusement for children.

Lastly, it is an object of the present invention to provide a new and improved combination water slide and pool including an inflatable elongated sliding sheet. An elevation ramp is secured to a lower surface of the sliding sheet inwardly of a short inner edge thereof. The elevation ramp has its apex at the short inner edge of the sliding sheet. A pool portion is secured to the short inner edge of the sliding sheet. The pool portion is comprised of a peripheral side wall.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 2 is a cross-sectional view of the present invention as taken along line 2—2 of FIG. 1.

FIG. 3 is a cross-sectional view of the present invention as taken along line 3—3 of FIG. 1.

The same reference numerals refer to the same parts through the various figures.

DESCRIPTION OF THE PREFERRED EMBODIMENT

Figure 1:
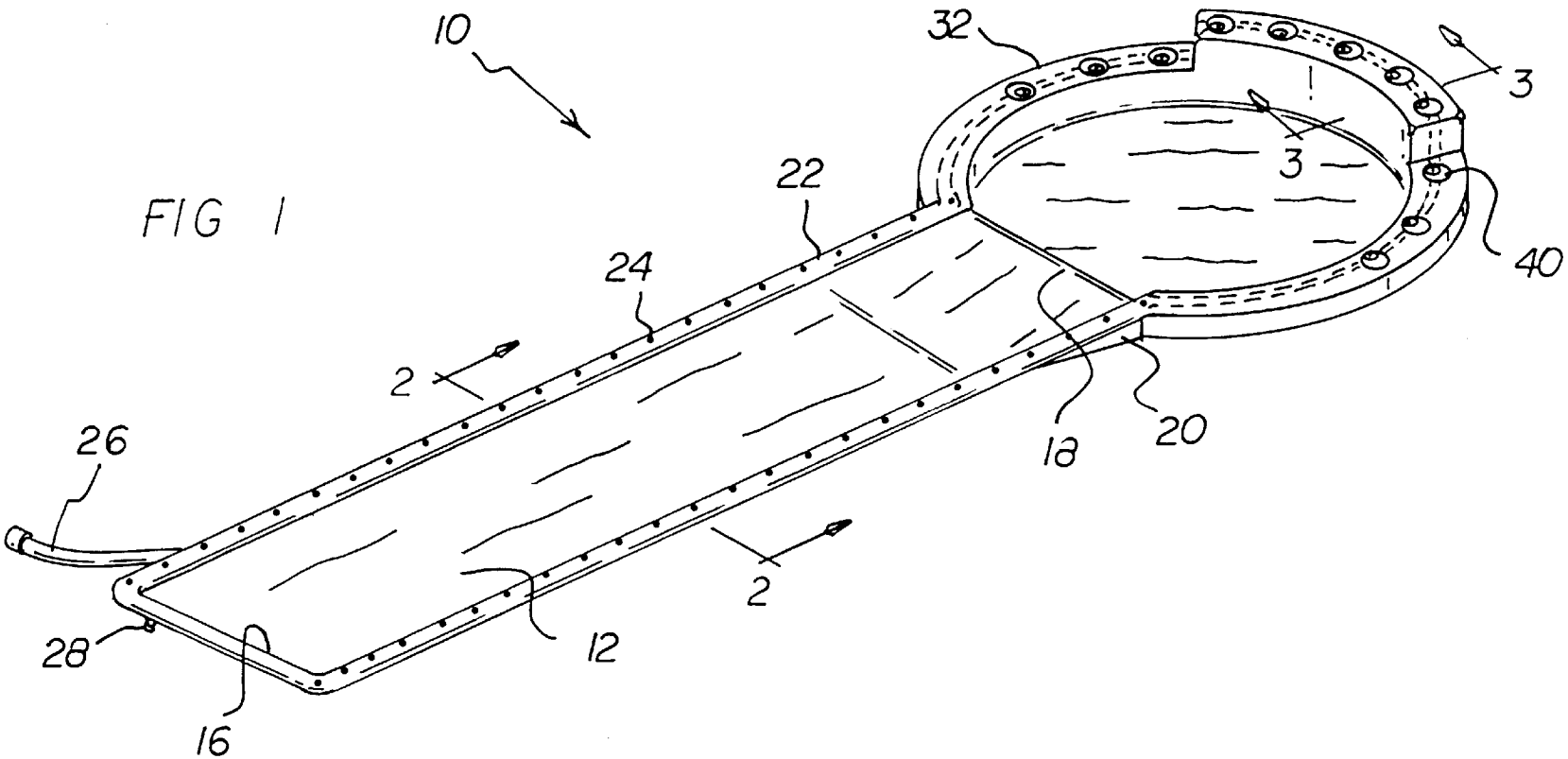
FIG. 1 is a perspective view of the preferred embodiment of the combination water slide and pool constructed in accordance with the principles of the present invention.

With reference now to the drawings, and in particular, to FIGS. 1 through 3 thereof, the preferred embodiment of the new and improved combination water slide and pool embodying the principles and concepts of the present invention and generally designated by the reference number 10 will be described.

Specifically, it will be noted in the various Figures that the device relates to a combination water slide and pool for providing recreation and amusement for children. In its broadest context, the device consists of an inflatable elongated sliding sheet, an elevation ramp, a peripheral conduit, and a pool portion. Such components are individually configured and correlated with respect to each other so as to attain the desired objective.

The inflatable elongated sliding sheet 12 has a generally rectangular configuration. The sliding sheet 12 has a periphery defined by a long opposed side edges 14, a short outer edge 16, and a short inner edge 18. The sliding sheet 12 is preferably inflatable and constructed of a durable plastic that will allow a child to slide upon when wet.

The elevation ramp 20 is secured to a lower surface of the sliding sheet 12 inwardly on the short inner edge 18 thereof. The elevation ramp 20 has its apex at the short inner edge 18 of the sliding sheet 12.

The peripheral conduit 22 extends around the long opposed side edges 14 and the short outer edge 16 of the inflatable sliding sheet 12 and terminates in open ends at opposing inner ends of the long opposed side edges 16. The peripheral conduit 22 has a plurality of pin holes 24 through an upper surface thereof in a spaced relationship. The peripheral conduit 22 has a water intake line 26 in communication therewith. The water intake line 26 has a coupling thereon to allow for the connection to a standard water hose or the like. The peripheral conduit 22 has an air intake 28 which is used to inflate the sliding portion 12 so as to provide a safe cushion for a person sliding on any terrain thereby allowing for the device 10 to be used on concrete and streets in addition to the primary use on grassy surfaces.

The pool portion 30 is secured to the short inner edge 18 of the sliding sheet 12. The pool portion 30 is comprised of a peripheral side wall 32. The peripheral side wall 32 allows the pool portion 30 to contain a quantity of water therein. The peripheral side wall 32 has a pair of end sections 34 at a height equal to the apex of the ramp 20 and an intermediate section 36 at an elevated height. Note FIG. 3. The peripheral side wall 32 has a conduit 38 extending therein. The conduit 38 is in communication with the open ends of the peripheral conduit 22. The conduit 38 of the pool portion 30 has a plurality of spray nozzles 40 in communication therewith and disposed within an upper surface of the peripheral side wall 32 in a spaced relationship. The spray nozzles 40 will allow the pressurized water to be sprayed outwardly of the pool portion 30. The pool portion 30 could also be provided with an additional air intake and water intake to improve the performance of the device 10 by increasing the air and water pressures. The pool portion 30 will be provided with an independent air intake valve 39. Note FIG. 3.

In use, water and air supply means are connected with the water intake 26 and air intake 28. This will cause the water to spray outwardly of the pin holes 24 and the spray nozzles 40. The pool portion 30 is the filled with water to create a wading area. The water sprayed from the pin holes 24 will create a wet sliding surface of the sliding sheet 12 to allow a child to slide along the length of the sliding sheet 12 and end up in the pool portion 30.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and the manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modification and changes will readily occur to those skilled in the art, it is not desired to limit the invention to the exact construction and operation shown and described, and accordingly, all suitable modification and equivalents may be resorted to, falling within the scope of the invention.

What is claimed as being new and desired to be protected by Letters Patent of the United States is as follows:

1. A combination water slide and pool for providing recreation and amusement for children comprising, in combination:

an inflatable elongated sliding sheet having a generally rectangular configuration, the sliding sheet having a periphery defined by a long opposed side edges, a short outer edge, and a short inner edge;

an elevation ramp secured to a lower surface of the sliding sheet inwardly of the short inner edge thereof, the elevation ramp having its apex at the short inner edge of the sliding sheet;

a peripheral conduit extending around the long opposed side edges and the short outer edge of the sliding sheet and terminating in open ends at opposing inner ends of the long opposed side edges, the peripheral conduit having a plurality of pin holes through an upper surface thereof in a spaced relationship, the peripheral conduit having a water intake line in communication therewith;

a pool portion secured to the short inner edge of the sliding sheet, the pool portion being comprised of a peripheral side wall, the peripheral side wall having a pair of end sections at a height equal to the apex of the ramp and an intermediate section at an elevated height, the peripheral side wall having a conduit extending therein, the conduit being in communication with the open ends of the peripheral conduit, the conduit of the pool portion having a plurality of spray nozzles in communication therewith and disposed within an upper surface of the peripheral side wall in a spaced relationship.

2. A combination water slide and pool for providing recreation and amusement for children comprising, in combination:

an inflatable elongated sliding;

an elevation ramp secured to a lower surface of the sliding sheet inwardly of a short inner edge thereof, the elevation ramp having its apex at the short inner edge of the sliding sheet;

a pool portion secured to the short inner edge of the sliding sheet, the pool portion being comprised of a peripheral side wall having a pair of end sections at a height equal to the apex of the ramp and an intermediate section at an elevated height.

* * * * *